US005758935A

United States Patent [19]

Coonan

[11] Patent Number: 5,758,935

[45] Date of Patent: Jun. 2, 1998

[54] COMPUTER WORKSTATION

[76] Inventor: Gary M. Coonan, 1420 Trotters La., Rockvale, Tenn. 37129

[21] Appl. No.: 727,372

[22] Filed: Oct. 8, 1996

[51] Int. Cl.[6] ..... A47B 81/00

[52] U.S. Cl. ..... 312/223.3; 312/249.11

[58] Field of Search ..... 312/194, 208.1, 312/213, 223.3, 7.2, 282, 249.8, 249.11; 108/50; 248/917

[56] References Cited

U.S. PATENT DOCUMENTS

| | | | |
|---|---|---|---|
| 2,044,559 | 6/1936 | Balster | 108/25 X |
| 2,841,410 | 7/1958 | Kessler, Jr. et al. . | |
| 2,879,561 | 3/1959 | Rieder | 292/87 X |
| 3,541,256 | 11/1970 | Anders | 248/917 X |
| 3,940,136 | 2/1976 | Runte | 248/917 X |
| 4,073,556 | 2/1978 | Wilson, Jr. | 248/917 X |
| 4,440,457 | 4/1984 | Fogelman et al. | 312/223.3 |
| 4,640,199 | 2/1987 | Zigman . | |
| 4,668,026 | 5/1987 | Lapeyre et al. . | |
| 4,828,340 | 5/1989 | Jorgensen | 312/213 X |
| 4,828,342 | 5/1989 | Stefan . | |
| 5,033,804 | 7/1991 | Faris . | |
| 5,071,204 | 12/1991 | Price et al. . | |
| 5,072,999 | 12/1991 | Trotta et al. | 312/249.8 |
| 5,087,010 | 2/1992 | Walters | 312/7.2 X |
| 5,118,172 | 6/1992 | Ugalde . | |
| 5,120,117 | 6/1992 | Williams . | |
| 5,259,668 | 11/1993 | Teufel et al. | 312/249.12 X |
| 5,271,669 | 12/1993 | Pearlson . | |
| 5,290,099 | 3/1994 | Lechman . | |
| 5,364,177 | 11/1994 | Ugalde . | |
| 5,393,025 | 2/1995 | Franklin | 248/917 X |
| 5,403,082 | 4/1995 | Kramer . | |
| 5,450,800 | 9/1995 | Leonard . | |
| 5,480,224 | 1/1996 | Ugalde . | |
| 5,489,938 | 2/1996 | Maruyama et al. | 312/223.3 X |
| 5,518,310 | 5/1996 | Ellman et al. | 312/223.6 X |

*Primary Examiner*—Peter M. Cuomo
*Assistant Examiner*—Janet M. Wilkens
*Attorney, Agent, or Firm*—Liell & McNeil

[57] ABSTRACT

A computer workstation for use in a hospital setting is described. The workstation includes a box shaped cabinet with a keyboard drawer slidably mounted to it. A window assembly is mounted to the top of the cabinet. The window assembly enables the user to view the monitor of the workstation which is mounted within the cabinet to its own base for sturdiness and damage prevention. The cabinet also includes four wheels mounted at each corner of its base. Optionally, the cabinet can include additional drawers for other computer parts and other supplies. The window assembly is substantially leak-proof to prevent chemicals and other hazardous materials from entering the interior of the cabinet and damaging the electronic equipment found within the cabinet. The fasteners that are used to mount the monitor and other parts to the cabinet are concealed inside the cabinet to provide a smooth and easy cleaning surface.

14 Claims, 6 Drawing Sheets

COMPUTER WORKSTATION

BACKGROUND OF THE INVENTION

The present invention relates generally to a computer workstation and more particularly to a computer workstation that is particularly suited for use in crowded work setting.

It will be appreciated by those having ordinary skill in the art that people who work in crowded and cramped workplaces and environments have special needs with regard to a computer terminal. Examples of such workplaces include hospitals, factories, laboratories, automobile service facilities, among a variety of others. Such a terminal needs to be portable and yet stable; needs to provide all of the computer equipment for data entry, and yet needs to maintain a small footprint to decrease the amount of floor space it utilizes. With the increased use of computer systems in a variety of fields, there is a particular need for such a workstation.

There have been several attempts to provide computer workstations. Examples of such attempts are described in U.S. Pat. Nos. 4,640,199; 5,271,669; 4,668,026; 5,033,804; 5,071,204; 5,290,099; 5,480,224; 5,364,177; and 5,118,172. However, none of these patents discuss the application of the computer workstations described therein to a crowded work setting and to a work setting where the computer systems will be exposed to harsh environmental conditions. Nor do any of these patents describe computer terminals that are particularly resistant to environmental hazards such as spills of chemicals, medications, or other materials or to the constant exposure to cleaning materials that may be required in some settings.

What is needed, then, is a computer workstation particularly designed for a work environment that is crowded, cramped, and often subjects the computer system housed within the workstation to harmful conditions. This device is presently lacking in the prior art.

SUMMARY OF THE INVENTION

A computer workstation comprising a cabinet having an interior and an exterior; a substantially leak proof window assembly connected to a top surface of the cabinet; and mounting means for mounting a computer monitor within the interior of the cabinet, said means located so that a user can view the monitor when using the workstation, is described. The computer workstation can further comprise a drawer slidably mounted to the cabinet for movement into and out of the cabinet. The computer workstation can also include a plurality of wheels mounted along a bottom surface of the cabinet. The window assembly and the mounting means can be connected to the cabinet with fasteners that are concealed within the cabinet. The mounting means can comprise a shelf and a belt mounted to the shelf, the belt securing the computer monitor.

Perferably, the cabinet is a substantially rectangular box, the box having a base with the wheels mounted on the base at each corner of the base. Further, vents can also be formed in sides of the cabinet. At least one additional drawer can also be slidably mounted for movement into and out of the cabinet. A shelf can also be mounted on a side of the cabinet, the shelf mounted for movement from an unextended position to an extended position. Preferably, the height of the cabinet is less than 40 inches vertically.

Accordingly, it is an object of this invention to provide a computer workstation that particularly suited for crowded working conditions, such as those found in hospitals, laboratories, factories, and the like.

It is an object of this invention to provide a computer workstation that utilizes a minimal amount of floor space.

It is a further object of this invention to provide a computer workstation that protects the computer system from damage from spills or other hazards in the work environment.

It is yet another object of this invention to provide a computer workstation with a low center of gravity.

It is yet a further object of this invention to provide a computer workstation that is very stable while stationary or in transit.

It is still a further object of this invention to provide a computer workstation that provides for confidential data entry.

Other objects and advantages will be apparent from the detailed description.

DESCRIPTION OF THE PREFERRED EMBODIMENT

Figure 1:
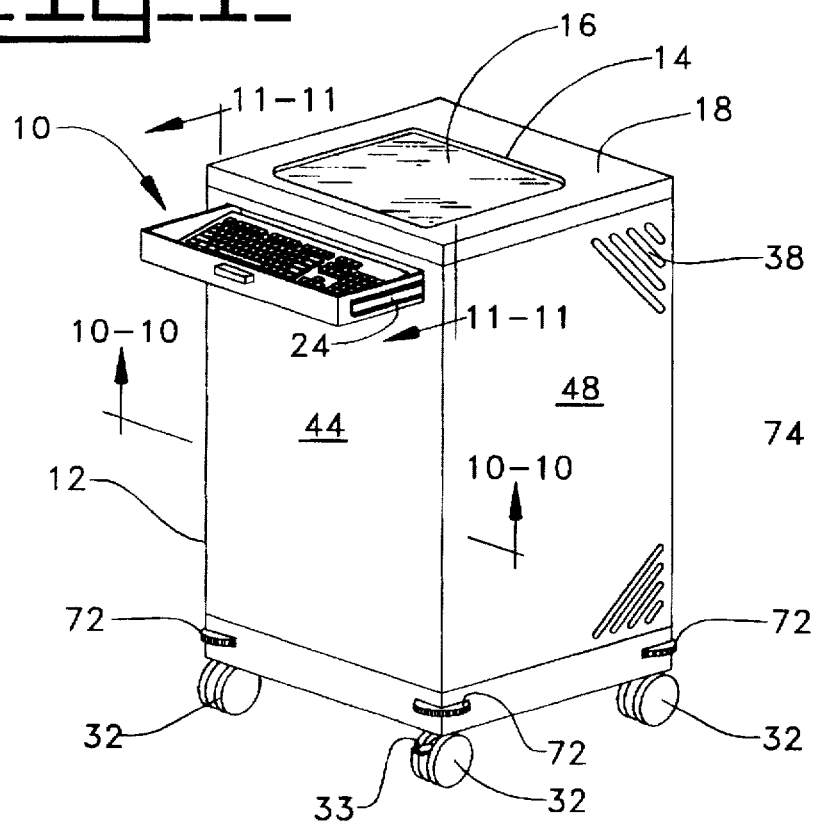
FIG. 1 is a perspective view of the computer workstation of this invention.
Figure 6:
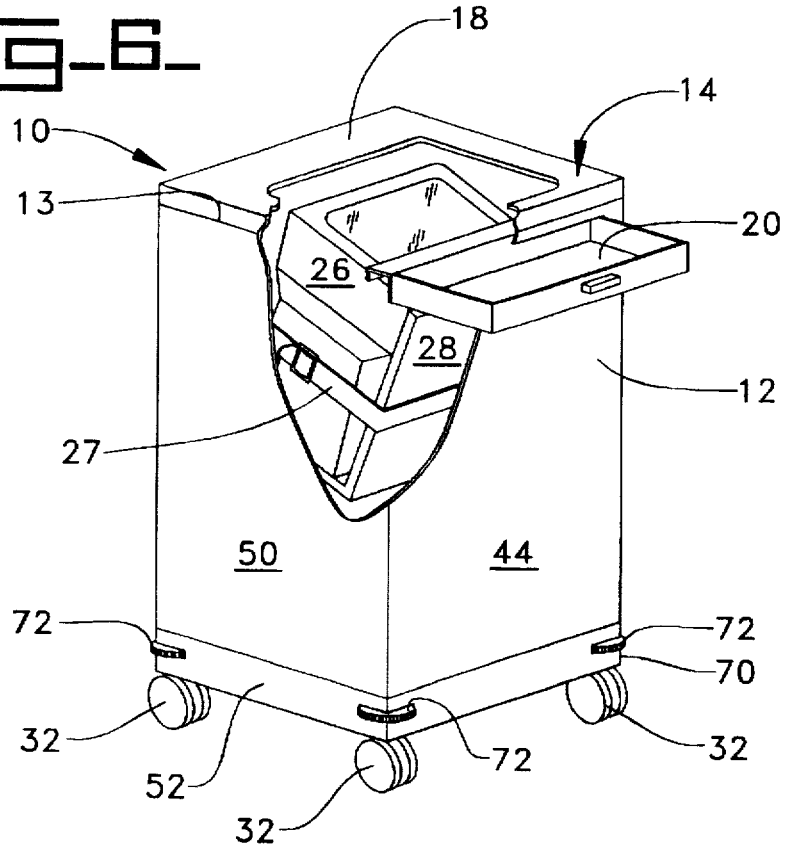
FIG. 6 is a cutaway perspective view of the computer workstation of this invention.

Referring now to the drawings, wherein like reference numerals refer to like parts throughout, the computer workstation of this invention is referred to generally at 10. Computer workstation 10 comprises a cabinet 12, window assembly 14, keyboard drawer 20, monitor mounting shelf 28 and casters 32. Referring particularly to FIGS. 1 and 6, cabinet 12 is preferably a substantially rectangular box including front side 44, rear side 46, right side 48, left side 50, and base 52.

Figure 2:
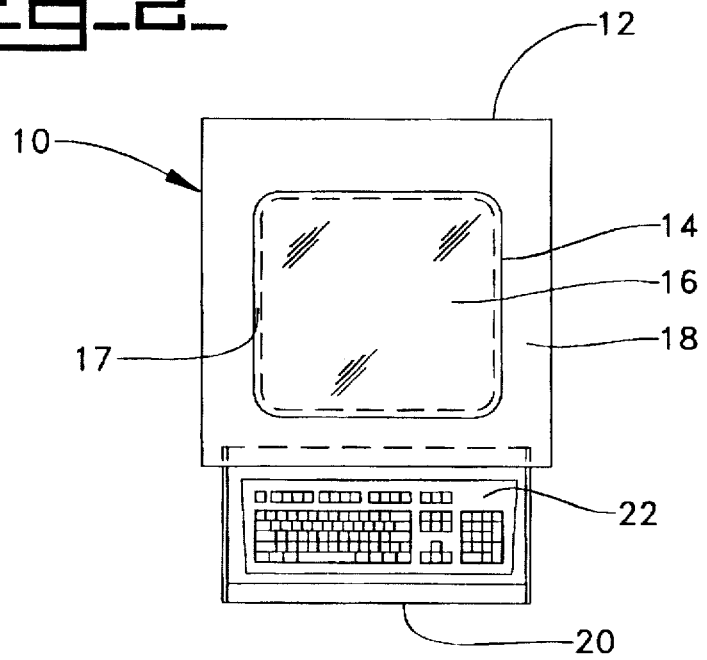
FIG. 2 is a top view of the computer workstation of this invention.

Continuing on FIGS. 1, 2 and 6, window assembly 14 is mounted along the top edges 13 of each side 44, 46, 48, 50 of cabinet 12. Window assembly 14 includes window 16 and frame 18. Window 16 is flush mounted within frame 18 to prevent leaks for entering the interior of cabinet 12. A continuous bead 17 (FIG. 2) of silicon is also placed between window 16 and frame 18 to enhance leak prevention. By the term "substantially leak-proof" as used herein and in the claims, it is meant that window asssembly 14 prevents leakage of practically all liquids or other spills that occur on window assembly 14 into the interior of the cabinet, but is not meant to require that absolutely no liquids enter the interior of the cabinet 12. Window 16 is preferably made of a durable material, such as polycarbonates, such as those manufactured under the trademark Lexan®, or tempered glass, to be impact resistant and to be chemical resistant for easy cleaning.

Figure 5:
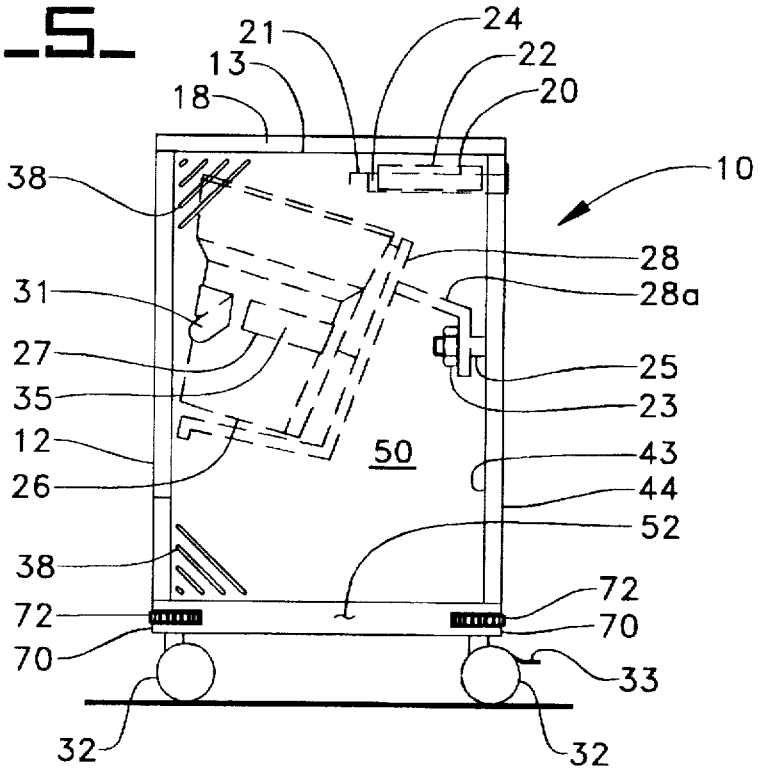
FIG. 5 is a left side view of the computer workstation of this invention.

As best seen in FIGS. 1, 5 and 6, keyboard drawer 20 preferably includes keyboard 22. Keyboard drawer 20 is mounted to a ball bearing slide 24 so that it slides into and out of cabinet 12. Slide 24 includes a catch 21 (FIG. 6) that secures drawer 20 when open by catching onto top edge 13 of front side 44.

As best seen in FIGS. 1 and 3–5, casters 32 are mounted at each corner 70 of base 52. Casters 32 include ball bearings, and are preferably of a relatively large diameter, such as 4 inches, and are extra wide, such as ½ inches, to decrease the amount of effort required to move the workstation 10 over rough floors and into and out of elevators. Additionally, it is preferable that casters 32 be made of a wear resistant material such as polyurethane. Casters 32 also include locking mechanisms 33 for stationary use. The preferred locking mechanism prevents the caster 32 from turning and from swiveling, and suitable examples can be obtained from Jilson Manufacturing, 20 Industrial Road, Lodi, N.J. 07644, part no. 1EB100MA-EUGR-Q20NQQ.

Continuing on FIGS. 1, 3, 4 and 5, each corner 70 of cabinet 12 includes a bumper 72.

Bumpers 72 enable the user to move the workstation 10 without worrying about damaging the corner 70 or damaging other equipment or walls on the user's premises.

Figure 4:
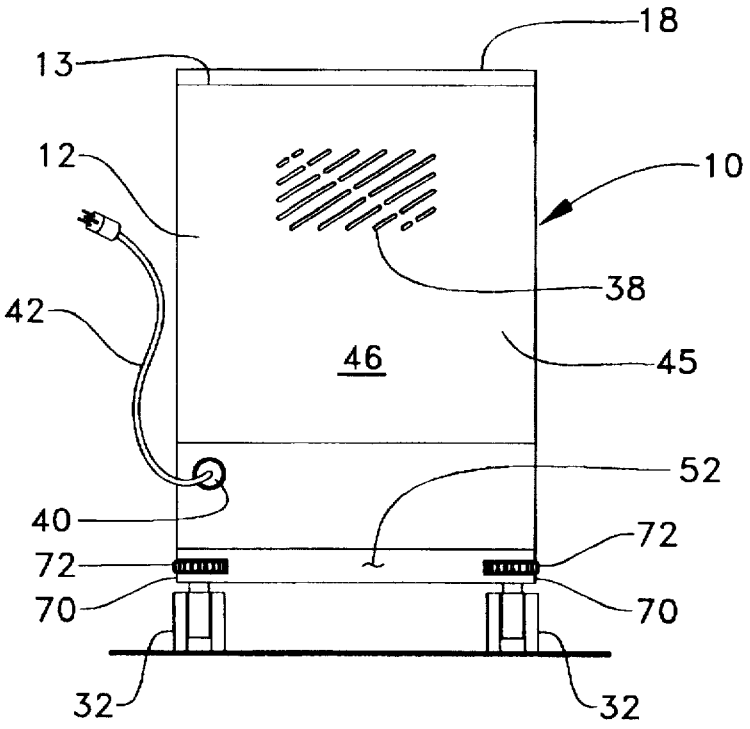
FIG. 4 is a rear view of the computer workstation of this invention.

As best seen on FIGS. 1, 4 and 5, cabinet 12 also includes cooling vents 38 which enable the electronic equipment contained within cabinet 12 to be ventilated. Additionally, cabinet 12 has an outer surface that comprises a powder coating 74. Powder coating 74 will not easily chip or scratch and is impervious to harsh chemicals that may be encountered in the user's setting. Preferably, cabinet 12 also comprises a sturdy steel construction.

Referring now to FIG. 4, the back side 46 of workstation 10 includes a portal 40 for a power cord 42 and other cords that facilitate connection of the workstation 10 to an external CPU. This enables the user to move the workstation from one data entry point to the next.

The back side 46 of workstation 10 also includes rear door 45. Rear door 45 is mounted to cabinet 12 using hinges, magnetic connections or other conventional means. Rear door 45 can be opened and/or removed so that the user can access the interior of the cabinet 12 to secure the monitor 26 as described below or to otherwise manipulate the computer equipment within cabinet 12. Rear door 45 can also include a lock.

Referring particularly to FIG. 5, a fastener 25 comprising a threaded stud is welded to the inside surface 43 of front side 44. A shelf 28 is mounted within cabinet 12 by mounting shelf extension **28*a* to threaded stud 25 using a nut 23. Thus, shelf 28 is mounted using a fastener that is concealed within cabinet 12. Monitor 26 is secured to shelf 28 using belt 27. Belt 27 includes hooks 31 on one side and eyes 35 on the other side, as commonly marketed under the tradename VELCRO®, and is looped around monitor 26, pulled snug, and secured back on itself to hold monitor 26 in place. Shelf 28 is located so that montior 26** can be easily viewed when mounted.

Figure 3:
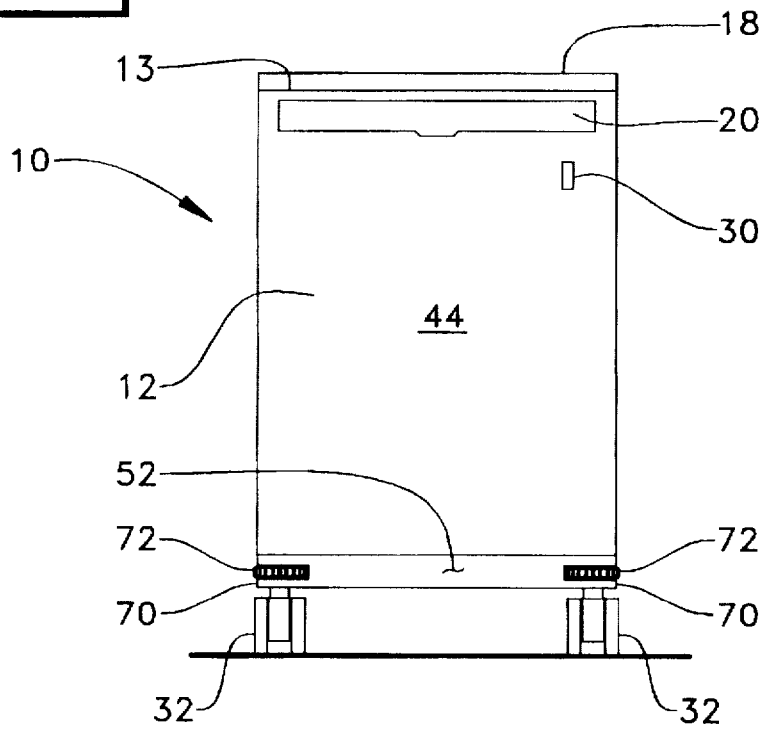
FIG. 3 is a front view of the computer workstation of this invention.

As best seen on FIG. 3, the front side 44 of the terminal 10 includes a power switch 30. Power switch 30 operates monitor 26 and can also operate additional equipment when alternative embodiments of the workstation 10 are used.

Figure 8:
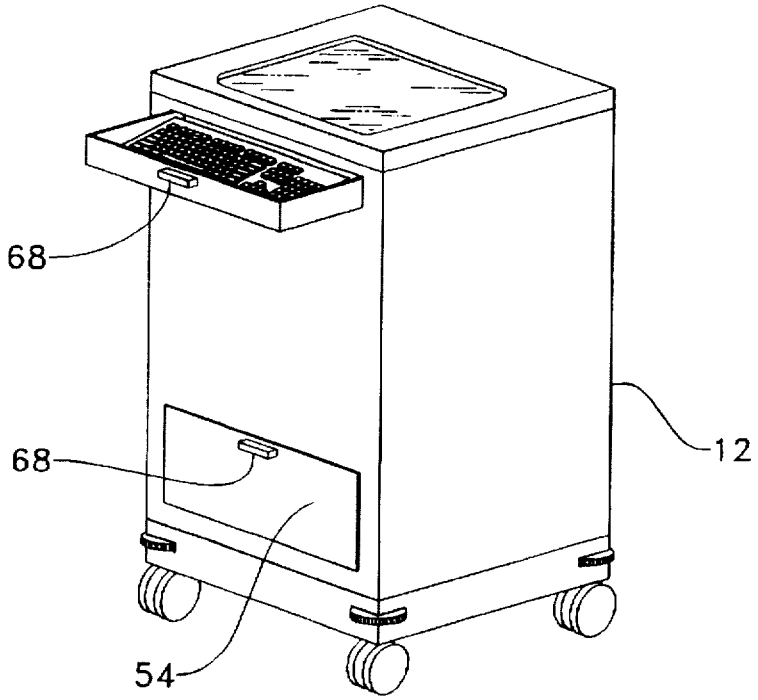
FIG. 8 is a perspective view of yet another alternative embodiment of the computer workstation of this invention.
Figure 9:
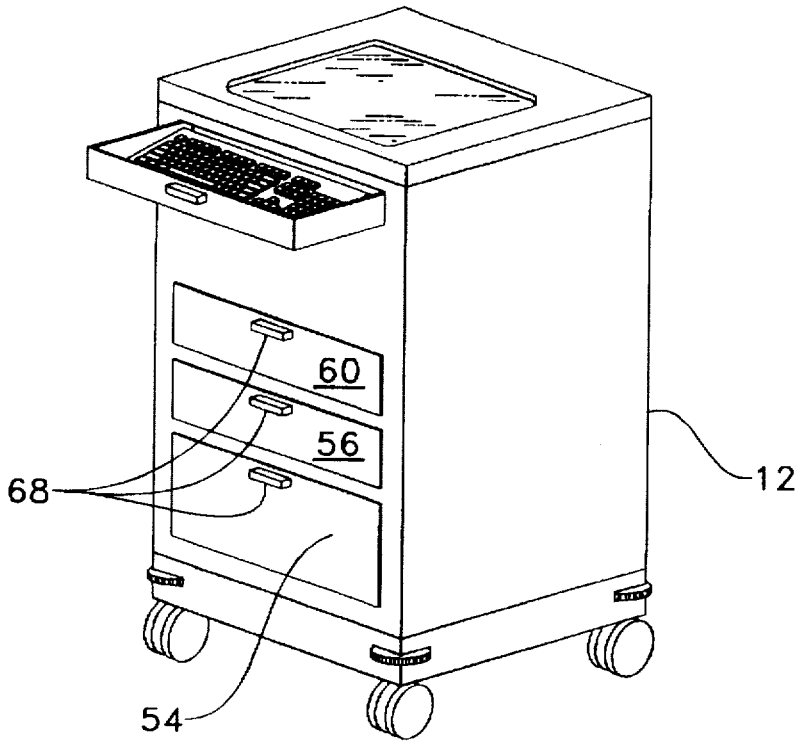
FIG. 9 is a perspective view of yet another alternative embodiment of the computer workstation of this invention.

Referring now to FIGS. 8 and 9, alternative embodiments of the workstation 10 are presented. These embodiments include accessory/storage drawers. Particularly referring to FIG. 8, the accessory drawer 54 is designed to accept the central processing unit (CPU) of a computer system. Referring now to FIG. 9, the drawers 54, 56 and 60 are designed to accept a CPU, a printer and other accessories, respectively. If desired, the drawers can be used for the storage of articles that are used for various purposes in the work setting. The addition of such drawers enables the user to customize workstation 10 according to the user's needs. Each drawer, including keyboard drawer 20 (FIG. 1), includes a handle 68 to facilitate opening and closing. Each drawer can also include a lock.

Figure 7:
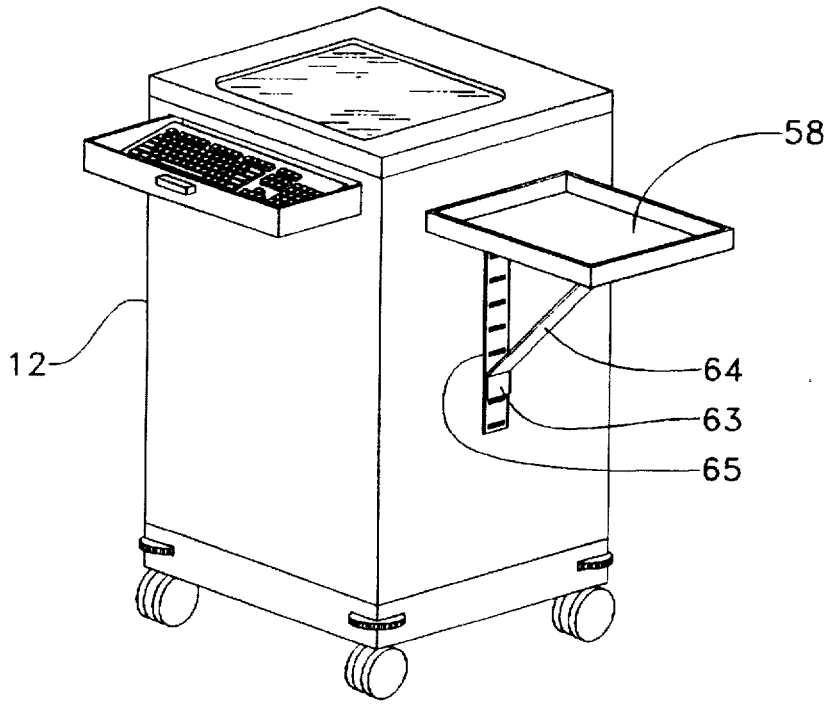
FIG. 7 is a perspective view of an alternative embodiment of the computer workstation of this invention.

Further, as seen in FIG. 7, a flip-up slide shelf 58 can also be provided. The slide shelf 58 is supported by strut 64. Slot 65 is provided for allowing strut 64 to move the shelf 58 to the extended position as shown in FIG. 6. Strut 64 is slidably mounted within slot 65 using mount 63.

Figure 10:
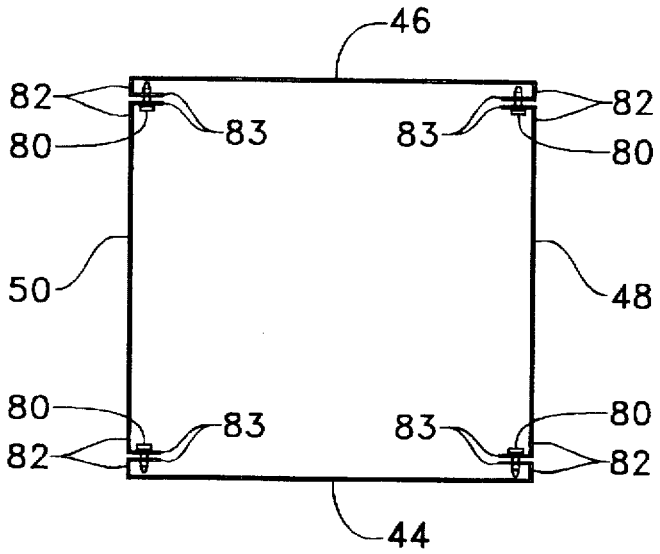
FIG. 10 is a horizontal sectional view along the line 10—10 in FIG. 1, showing how the sides of the cabinet of the computer workstation are fastened together.
Figure 11:
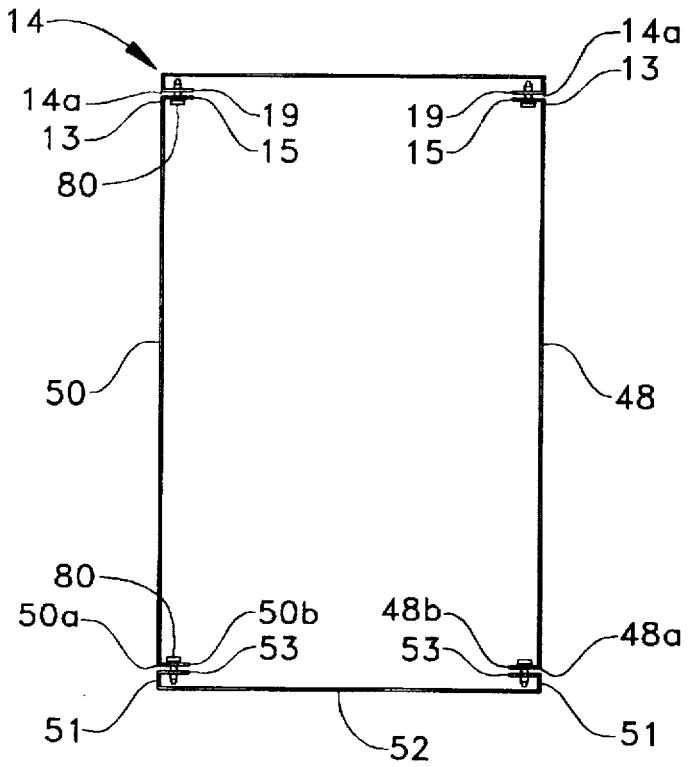
FIG. 11 is a vertical sectional view along the line 11—11 in FIG. 1, showing how the window assembly and base are attached to the sides of the cabinet of the computer workstation are fastened together.
Figure 12:
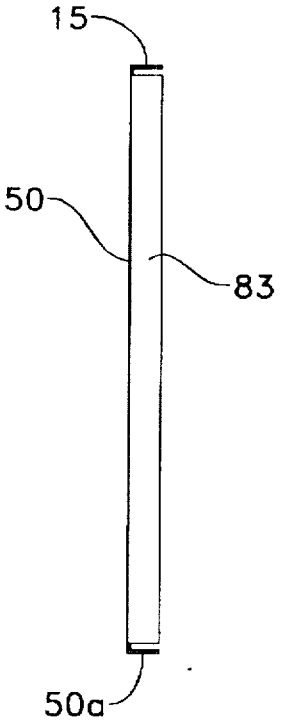
FIG. 12 is a front view of left side of the cabinet of the computer workstation of this invention exploded away the cabinet.

The fasteners that are used to connect window assembly 14 to cabinet 12 and to connect sides 44, 46, 48, 50 and 52 of cabinet 12 are concealed inside for a smooth, catch free surface. An example of such as fastener is screw 80, which is shown in FIGS. 10 and 11. Side edges 82 of each side 44, 46, 48, and 50 are bent inwardly as shown in FIG. 10 to form flanges 83 and flanges 83 are connected using screws 80. As seen in FIG. 11, top edges 13 of right and left sides 48 and 50 are also bent inwardly to form flanges 15. The bottom edge **14*a* of window assembly 14 is also bent inwardly to form flange 19. The bottom edges 48*a* and 50*a* of right and left sides 48 and 50 are also bent inwardly to form flanges 48*b* and 50*b*. The top edge 51 of base 52 is also bent inwardly to from flange 53. Flanges 15 and 19 and flanges 48*b* and 50*b* and 53 are connected using screws 80. FIG. 12 is a front view of left side 50 exploded away from cabinet 12 and showing the relationship of flanges 15 and 50*b* and flange 83**.

TABLE 1

| Cabinet Dimensions | | Operating Temperature |
|---|---|---|
| H38" × W21.5" × D21.5" | | −20 F. to 80 F. |
| Keyboard Height | | Electrical Service |
| 36" | | 120 Volts @ 10 Amps<br>2 Outlets<br>12 ft. Spiral cord |
| Drawer Size | | |
| Top | H6" × W19" × D5¾" | |
| Middle | H6" × W19" × D7¾" | |
| Bottom | H9" × W19" × D17" | |

Table 1 includes information concerning operating temperatures, drawer sizes, and the electrical service required for workstation 10. The dimensions also enable the workstation 10 to occupy only 3½ square feet of floor space in the preferred embodiment and provide for a low center of gravity. Additionally, the preferred workstation 10 has a low center of gravity and is stable when stationary or in transit. Thus, preferably, the workstation does not exceed 40 inches in height.

Thus, although there have been described particular embodiments of the present invention of a new and useful Computer Workstation, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What is claimed is:

1. A computer workstation comprising:

a cabinet having an interior and an exterior with a horizontal top;

a portion of said top being a substantially leak-proof window;

a threaded stud mounted in said interior of said cabinet;

a shelf attached to said threaded to stud with a nut;

a computer monitor attached to said shelf under said window;

a keyboard support attached to said cabinet and being movable between a first position and a second position;

a computer keyboard positioned on said keyboard support; and said computer keyboard being in said interior of said cabinet when said keyboard support is in said first position, but said computer keyboard being exposed when said keyboard support is in said second position.

2. The computer workstation of claim 1 wherein said keyboard support is a keyboard drawer positioned under said window but above a portion of said computer monitor; and said exterior of said cabinet presents a smooth, catch-free surface when said keyboard support is in said first position.

3. The computer workstation of claim 1 wherein said cabinet includes a plurality of sides attached to one another with fasteners located in said interior; and said exterior of said cabinet presents a smooth, catch-free surface when said keyboard support is in said first position.

4. The computer workstation of claim 1 further comprising a plurality of lockable casters attached to a bottom of said cabinet; and a plurality of bumpers attached to said exterior of said cabinet.

5. The computer workstation of claim 1 wherein said exterior of said cabinet is substantially rectangular, has a height less than about 40 inches and a base sized to occupy less than about 3½ square feet of floor space.

6. The computer workstation of claim 1 further comprising a shelf mounted on said exterior of said cabinet and being movable between an extended position and an unextended position.

7. A computer workstation comprising:

a cabinet having an interior and an exterior defined by a plurality of sides attached to one another with fasteners located in said interior, and a top side of said exterior is horizontal and free of openings to said interior, and said exterior of said cabinet is substantially rectangular, has a height less than about 40 inches and a base sized to occupy less than about 3 ½ square feet of floor space;

a portion of said top side being a substantially leak-proof window;

a threaded stud mounted in said interior of said cabinet;

a shelf attached to said threaded stud with a nut;

a computer monitor attached to said shelf under said window;

a keyboard drawer attached to said cabinet above a portion of said computer monitor and being movable between a first position and a second position;

a computer keyboard positioned in said keyboard drawer;

said computer keyboard being in said interior of said cabinet when said keyboard drawer is in said first position, but said computer keyboard being exposed when said keyboard drawer is in said second position; and said exterior of said cabinet presents a smooth, catch-free surface when said keyboard drawer is in said first position.

8. The computer workstation of claim 7 further comprising a plurality of lockable casters attached to a bottom of said cabinet; and a plurality of bumpers attached to said exterior of said cabinet.

9. The computer workstation of claim 7 further comprising means for connecting said computer monitor and said computer keyboard to a computer located outside said exterior of said cabinet;

a power cord with one end located in said interior of said cabinet and a plug end extending through one of said plurality of sides outside said exterior of said cabinet; and wherein at least one of said plurality of sides includes cooling vent openings.

10. The computer workstation of claim 7 wherein one of said plurality of sides includes a door sized to allow access to said interior and said computer monitor.

11. The computer workstation of claim 7 further comprising a shelf mounted on said exterior of said cabinet and being movable between an extended position and an unextended position.

12. A computer workstation comprising:

a cabinet having an interior and an exterior defined by a plurality of sides attached to one another with fasteners located in said interior, and a top side of said exterior is horizontal and free of openings to said interior, and said exterior of said cabinet is substantially rectangular, has a height less than about 40 inches and a base sized to occupy less than about 3½ square feet of floor space, and at least one of said plurality of sides including cooling vent openings a portion of said top side being a substantially leak-proof window;

a threaded mounted in said interior of said cabinet;

a shelf attached to said threaded stud with a nut;

a computer monitor attached to said shelf under said window;

a keyboard support attached to said cabinet above a portion of said computer monitor and being movable between a first position and a second position;

a computer keyboard positioned on said keyboard support;

said computer keyboard being in said interior of said cabinet when said keyboard support is in said first position, but said computer keyboard being exposed when said keyboard support is in said second position;

said exterior of said cabinet presents a smooth, catch-free surface when said keyboard support is in said first position a plurality of lockable casters attached to a bottom of said cabinet; and a plurality of bumpers attached to said exterior of said cabinet;

a power cord with one end located in said interior of said cabinet and a plug end extending through one of said plurality of sides outside said exterior of said cabinet; and one of said plurality of sides including a door sized to allow access to said interior and said computer monitor.

13. The computer workstation of claim 12 further comprising a shelf mounted on said exterior of said cabinet and being movable between an extended position and an unextended position.

14. The computer workstation of claim 12 wherein said keyboard support is a keyboard drawer positioned under said window but above a portion of said computer monitor.

* * * * *